United States Patent [19]

Bjurström

[11] 4,387,624

[45] Jun. 14, 1983

[54] DEVICE FOR INCREASING THE TRACKING ACCURACY OF AN AIMING SYSTEM

[75] Inventor: Lennart Bjurström, Karlskoga, Sweden

[73] Assignee: Aktiebolaget Bofors, Bofors, Sweden

[21] Appl. No.: 192,658

[22] Filed: Oct. 1, 1980

[30] Foreign Application Priority Data

Oct. 2, 1979 [SE] Sweden ..... 7908148

[51] Int. Cl.[3] ..... F41G 5/14; G05B 13/00

[52] U.S. Cl. ..... 89/41 LE; 318/621; 318/622

[58] Field of Search ..... 89/41 M, 41 LE, 41 H; 318/609, 619, 621, 622

[56] References Cited

U.S. PATENT DOCUMENTS 2,414,924 1/1947 Borden ..... 89/41 M 3,055,180 9/1962 Kane ..... 89/41 H 4,256,015 3/1981 Tippetts et al. ..... 89/41 LE

*Primary Examiner*—Stephen C. Bentley

*Attorney, Agent, or Firm*—Pollock, Vande Sande & Priddy

[57] ABSTRACT

The invention relates to a device for increasing the tracking accuracy of an aiming system for a gun or the like which includes a gun servo. The gun servo comprises a special stabilizing and accuracy-increasing network (20) which comprises one or a plurality of integrating second-degree filters (25) the transmission functions ($G_R$) of which have such a form that the amplitude as a function of the frequency has a maximum near the expected frequency of the base movements of the gun and/or the movement of the target, which makes it possible to have a high system gain around and below said frequency.

6 Claims, 4 Drawing Figures

DEVICE FOR INCREASING THE TRACKING ACCURACY OF AN AIMING SYSTEM

Figure 1:
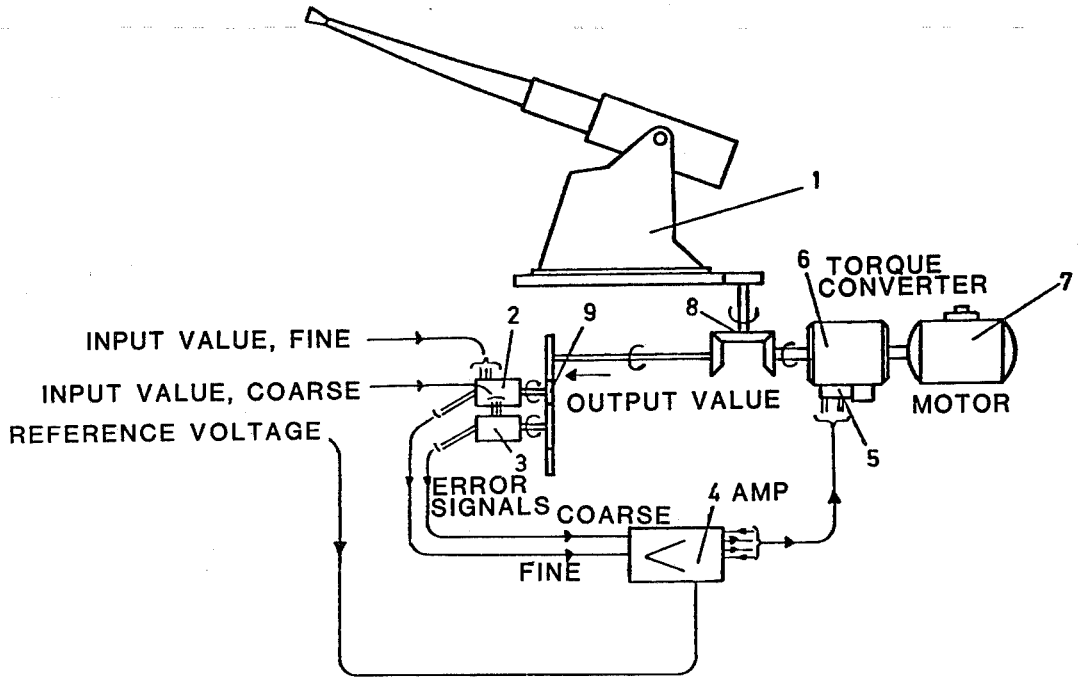

The present invention relates to a device for increasing the tracking accuracy of an aiming system, for instance a gun with a gun servo for aiming at a target.

An aiming or control system for a gun usually comprises comparison means in the form of synchros, which compare an input signal, the commanded angle of traverse or angle of elevation, with the actual angle of traverse or angle of elevation of the gun. The synchros emit error signals which correspond to the difference between the commanded angle and the actual angle of the gun, the angular error. With the aid of signal processing means the error signals are converted into an appropriate form and are fed to the control means and torque converter of the gun. The torque converter then drives the gun and the control transformer synchros via gear transmissions until the angular error becomes zero.

Signal processing means convert the angular error signals from the synchros into an appropriate voltage level and to an appropriate form in special filters which have such properties that a rapid slewing-on to target process and a stable and accurate aiming system shall be obtained. The signals are thereafter converted into two direct currents in the windings of the pilot magnet.

The size and sign of the angular error, i.e. the difference between the command angle from the fire control equipment and the angle of the gun, is thus converted in the signal processing means into two direct currents, the difference between which will then determine the direction of movement and acceleration of the gun.

The gun control normally comprises two phases, a slewing-on mode and a target tracking mode. During the tracking mode, accurate tracking of a target, with small angular errors, is sought.

When calculating the tracking accuracy, only low-frequency processes are of interest. Low-frequency variations of the commanded angle can be caused by target movements and also by base movements, for instance the rolling of a ship in the case of a naval gun or movements of a vehicle moving on the ground in case of a vehicle-based gun. For a naval gun, target movements with frequencies of up to approx. 0.5 Hz can be considered reasonable, while there are base movements with frequencies of up to 0.2–0.3 Hz. For a second order system, it can be shown that at target and base movements, the tracking accuracy is determined approximately by $$x-y=(\omega^2 x)/K_a$$

in which x = angle commanded by the fire control equipment, y = gun angle, $K_a$ = the so-called acceleration constant which constitutes a measure of the circuit amplification, and $\omega^2 x$ = command angular acceleration From this equation it will be noted that a high acceleration constant $K_a$ is desirable from the point of view of accuracy. However, the stability requirement sets a practical maximum limit for $K_a$. As an example may be mentioned that for a previously known gun the acceleration constant amounts to $K_a=250\ s^{-2}$. On, for instance, a ship rolling with 0.2 Hz and 7° amplitude, the elevating mass of the gun, during tracking in direction starboard or port, will be commanded with an angular variation of ±7° with a frequency of 0.2 Hz. The above-mentioned equation then gives a maximum tracking error of x−y=0.8 mrad.

For a vehicle-mounted gun, for example a tank, moving on the ground, base movements with a frequency of up to approx. 1 Hz and with amplitudes of up to 10° can be considered reasonable.

In order to increase the target tracking accuracy, taken by itself, the system could have broad bandwidth with a high acceleration constant and with sufficient phase margin, but in practice this is inappropriate, as the sensitivity of the gun to disturbances increases correspondingly. With such parameters it would be necessary to lower the limit for the maximum permissible disturbance level in the fire control signals to unacceptable values. By fire control disturbances is usually meant the high-frequency part of the angle commanded by the fire control equipment, which from the point of view of target tracking is uninteresting. The disturbances are measured in angular acceleration, mrad/s$^2$, since it is just the acceleration of the gun which is controlled.

For several reasons, the disturbance level must be limited:

1. The tracking accuracy decreases due to overmodulation of amplifiers and hydraulics.
2. Vibrations involve increased wear in servo motors and transmissions.
3. Jerking and shaking is very irritating to the gun crew.

The purpose of the present invention is to achieve a device of the above-mentioned kind in which the system amplification can be increased considerably without affecting the stability at higher frequencies and without needing to lower the limit for the maximum permissible disturbance level in the fire control signals.

The invention is characterized in that the gun servo comprises an accuracy-increasing network comprising one or a plurality of integrating second degree filters, the transmission functions of which have such a form that the amplitude as a function of the frequency has a maximum around the expected frequency of the base movements of the gun and/or the movement of the target, which makes it possible to have a high amplification of the system around and below said frequency.

Figure 2:
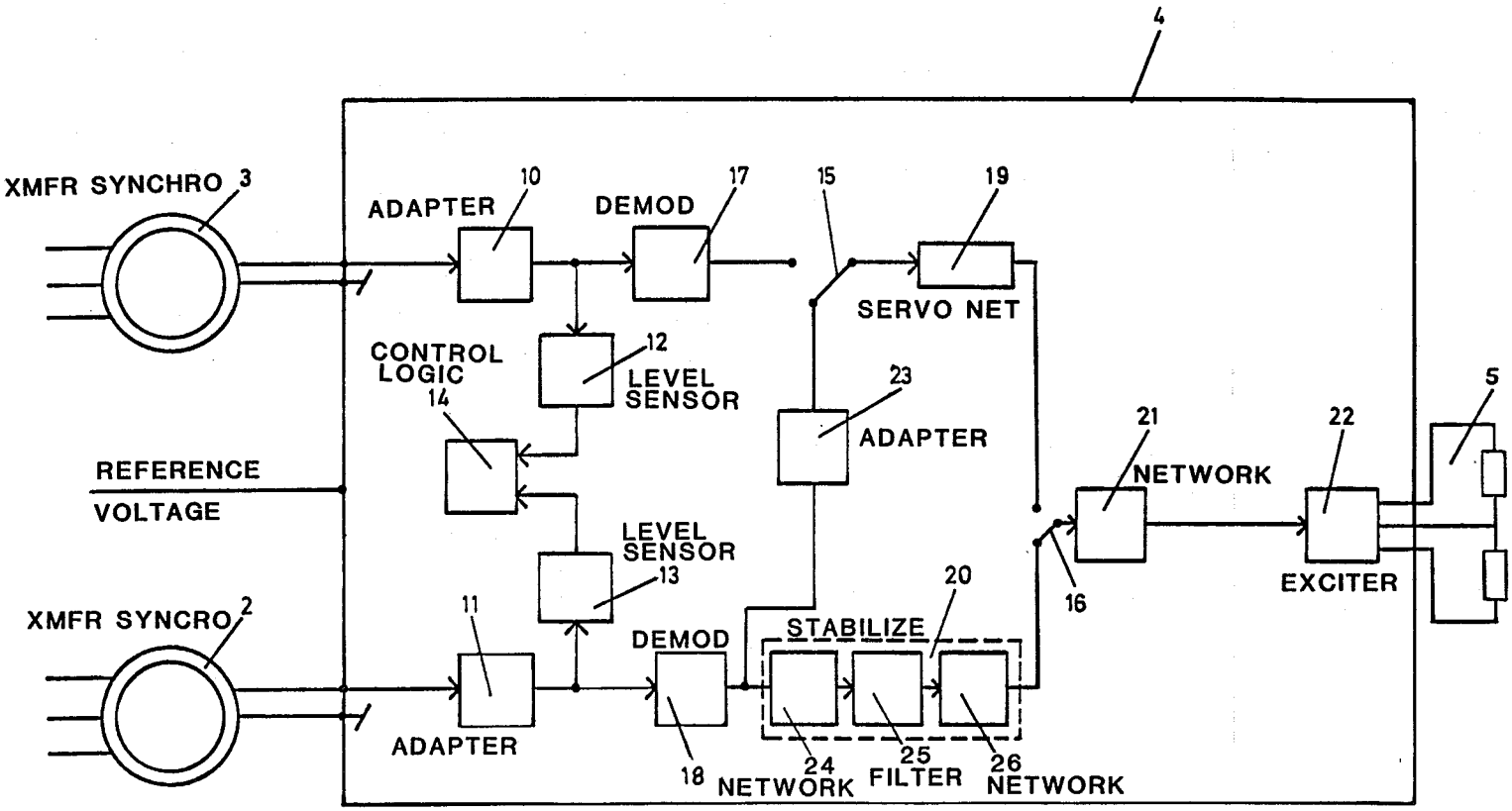
Figure 3:
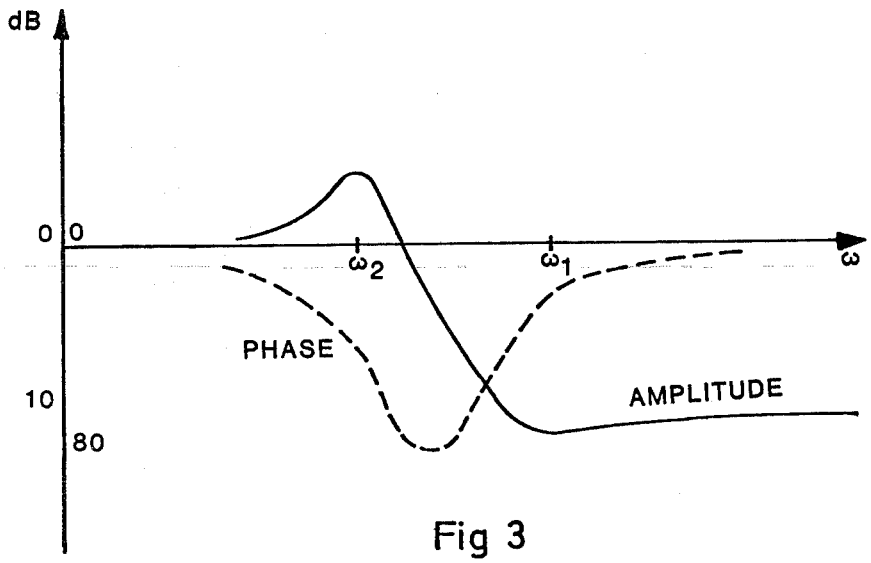
Figure 4:
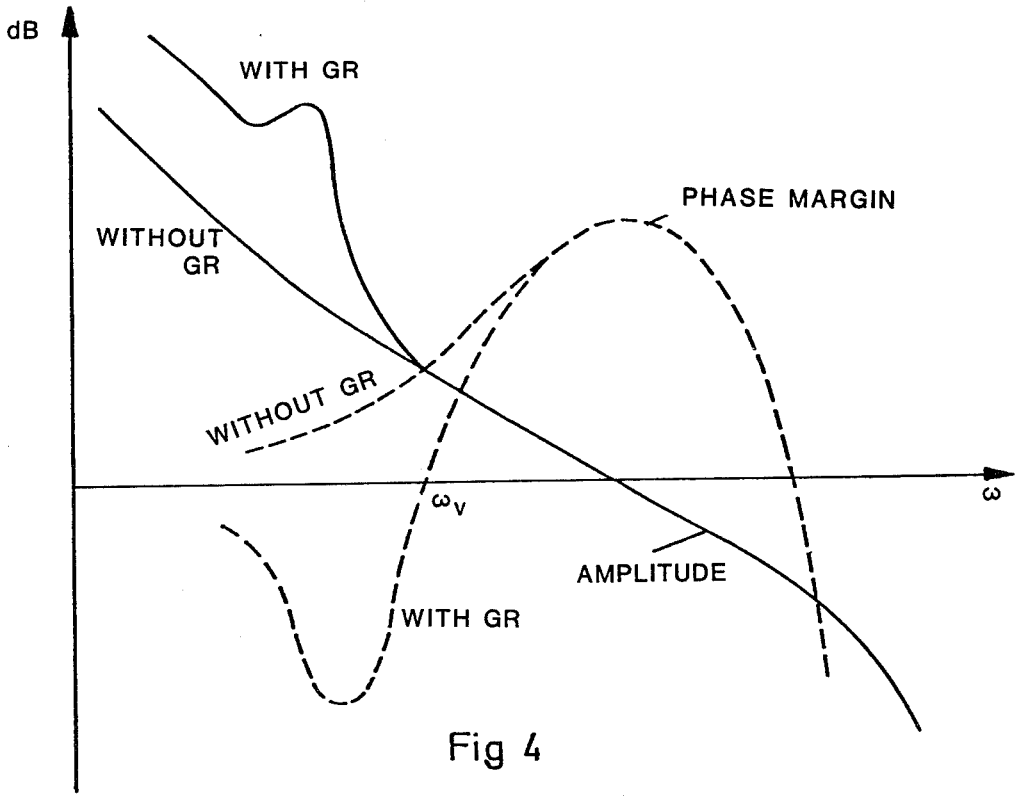

In the following, the invention will be described in more detail with reference to the accompanying drawings, which as an example of a favourable embodiment show an aiming system comprising a naval gun, and in which FIG. 1 schematically shows the design of the gun servo, FIG. 2 with the aid of a block diagram shows the amplification or signal processing means, FIG. 3 shows the transmission function of the accuracy-increasing filter with the aid of a Bode diagram, and FIG. 4 shows the transmission function of the entire aiming system, with and without the accuracy-increasing filter.

An aiming or control system for a gun usually comprises both a traversing system and an elevating system. The two systems work in an analogue way, and entirely separate from each other, and therefore, in the following, only one of the aiming systems, the traversing system, will be described in detail. The aim of the gun is determined by angles of traverse and elevation which are commanded from a fire control installation, but the device can also be applied when controlling from the built-in control devices on the gun.

FIG. 1 shows schematically how the traversing system, the gun servo, of a gun 1, for instance a ship-based naval gun, is designed. From a fire control installation (not shown) two input signals are fed in a known way, the commanded coarse and fine angle of traverse x. The fine system comprises a control transformer synchro 2 and the coarse system a control transformer synchro 3, the rotor positions of which in a known way via gear transmissions are determined by the actual angle of traverse y of the gun. From these synchros the angular error is obtained, i.e. error signals which correspond to the difference between the commanded angle of traverse and the angle of the gun. In a known way, a coarse and fine system has been used, in which the synchro 3 of the coarse system has the ratio of 1:1 and the synchro 2 of the fine system n:1 in relation to the actual angle of the gun. The coarse system takes care of the control far from the coincidence position, while the fine system automatically takes over when the angular error becomes small.

The error signals (the angular error) from synchros 2 and 3 are fed to an amplifier device 4 where the signals are converted into an appropriate form and size. As will be noted from the figure, a reference voltage is also fed to the amplifier device.

The amplifier device 4 emits a pilot signal to the control means 5 of the gun and the torque converter 6 connected to an electric motor 7. The output shaft of the torque converter obtains a rotating movement which is determined by the angular error, and which via gear transmissions 8 and 9 will drive the gun and the control transmitter synchros 2 and 3, respectively, until the angular error becomes zero.

FIG. 2 shows, with the aid of a block diagram, the design of the amplifier device 4. The device mainly comprises two separate signal channels, one for the coarse signal and one for the fine signal. The angular error signals from the coarse and fine synchros 3 and 2, respectively, are converted into an appropriate voltage level in adapter units 10 and 11. The signal channel in question is determined by level sensors 12, 13, connected to the output of the adapter units 10 and 11, together with a control logic 14 through change-over switches 15 and 16. In both the coarse and fine channels there are means 17 and 18 for demodulation and filtering of the signals. The signals are thereafter processed in a servo network 19 (the coarse channel) and in a stabilizing and accuracy-increasing network 20 (the fine channel) respectively. The servo network 19 has a stabilizing function, and is designed to give the gun rapid braking. The stabilizing and accuracy-increasing network 20 will be described in more detail in the following description. Through the change-over switch 16 one of the signals is fed on to a load-compensating network 21 and an exciter 22, and is emitted as a pilot signal in the form of two direct currents to the pilot magnet 5 of the gun.

In principle, the amplifier device 4 functions in the following way. During the slewing-on phase, the gun is controlled by the coarse channel, i.e. the control logic 14 has the change-over switches 15 and 16 set in such a position that the signal passes the adapter unit 10, the means 17, and the servo network 19. When the coarse signal assumes a certain value, for instance 30 mrad, a change-over switching takes place so that the error signal is instead taken from the fine synchro 2, but the control still takes place via the servo network 19, i.e. the signal passes the adapter unit 11, the means 18, a further adapter unit 23 and the servo network 19. When the fine error signal goes below a new value, for instance 10 mrad, a time lag is initiated, which after t seconds connects the stabilizing and accuracy-increasing network 20 into the fine channel instead of the servo network 19. If thereafter the error signal exceeds this value (10 mrad) the network 20 is disconnected again, without any time lag.

In the following, we shall disregard the slewing-on phase and instead see what happens at accurate tracking of a target, i.e. when the angular error x−y is small.

Through control-technical analyses of the system, which are known in themselves, for instance with a Bode diagram, it is known that a high circuit amplification is necessary in order to obtain good tracking accuracy in the system, but at the same time the requirement for stability sets a practical upper limit for this amplification. In order to be able to increase the circuit amplification without at the same time affecting the stability at higher frequencies, a special stabilizing and accuracy-increasing network is utilized in the fine channel, consisting of a stabilizing network 24, an integrating second-degree filter 25, and a load and phase-compensating network 26.

The stabilizing network 24 has a transfer function $G_D$ which with the aid of the Laplace transform can be written $$G_D = \frac{1 + sTd}{1 + sT_f}$$

in which $T_d$ and $T_f$ are constants determined by the value of the components comprising network 24 through conventional circuit analysis. The network 24 gives the basic contribution to the phase margin which is necessary for the stability of the system.

The integrating second-degree filter 25 has a transfer function $G_R$ which with the aid of the Laplace transform can be written $$G_R = \frac{1 + 2\rho_1 \frac{s}{\omega_1} + \frac{s^2}{\omega_1^2}}{1 + 2\rho_2 \frac{s}{\omega_2} + \frac{s^2}{\omega_2^2}}$$

in which $\omega_1$ and $\omega_2$ are just above the expected frequency of the base movement, for instance the rolling frequency of a ship, and/or the movement of the target, and in which $\rho_1$ and $\rho_2$ consist of constants, so-called damping factors. The damping factors together with $\omega_1$ and $\omega_2$ are chosen in such a way that the transfer function $G_R$ will obtain an appropriate phase and amplitude.

FIG. 2 also shows an integrating second-degree filter 25. However, one or a plurality of further filters of the same type can be connected in series in the network or, alternatively, a network with a transfer function other than $G_R$, but with a similar phase and amplitude, can be connected.

The transfer function of the filter 25 can be illustrated with the aid of a Bode diagram, see FIG. 3, in which the amplitude and phase angle have been drawn as a function of $\omega$, and in which the breaking frequencies $\omega_1$ and $\omega_2$ have been indicated.

FIG. 4 shows, also with the aid of a Bode diagram, how the transfer function of the entire aiming system is improved through the introduction of the filter 25. The solid lines indicate the amplitude, without $G_R$ and with $G_R$, while the dash lines indicate the phase margin, without $G_R$ and with $G_R$, respectively. While retaining essentially identical amplitude and phase at higher frequencies, through the introduction of $G_R$, a several times higher circuit amplification can be used, for instance a higher $K_a$ value, thereby achieving the corresponding increase of the tracking accuracy.

As will be noted from the figure, the "hump" in $G_R$ at the breaking frequency $\omega_2$ has further considerably increased the accuracy in the system in the range around this frequency. This frequency range is usually the most critical frequency. From the curves, it will also be noted that a so-called conditional stability arises at the frequency $\omega_v$. At this frequency, the amplification margin must be so great that the non-linearity in the system does not give natural frequencies of a visible amplitude. The introduction of the filter 26 will thus involve more stringent requirements for the linearity of the components used in the aiming system.

The load and phase-compensating network has the same configuration as the filter 25, but with breaking frequencies in the vicinity of the cross-over frequency of the amplitude function. Also the load-compensating network 21 has the same configuration as the networks 25 and 26, but the breaking frequencies are located in the vicinity of the natural frequency of the system. The networks 21 and 26 are of the derivating type, with phase and amplitude substantially similar to the inverse of the network 25.

I claim:

1. A device for increasing the tracking accuracy of a gun aiming servo system for a moving target comprising:

a stabilizing and accuracy increasing network for processing a signal in said servo system, said network including an integrating second order filter having a transfer function of $$\frac{1 + 2\rho_1 \frac{s}{\omega_1} + \frac{s^2}{\omega_1^2}}{1 + 2\rho_2 \frac{s}{\omega_2} + \frac{s^2}{\omega_2^2}}$$

where $\rho_1$ and $\rho_2$ are damping factors, and $\omega_1$ and $\omega_2$ are angular frequencies of the gun base movements and target and said transfer function has a maximum amplitude for signals which have a frequency of substantially $\omega_1$ and $\omega_2$.

2. A device according to claim 1 wherein said servo system comprises a ship-based naval gun, radar equipment, optical or optronic sight, the frequencies $\omega_1$ and $\omega_2$ are substantially at the rolling frequency of the ship.

3. A device according to claim 1 wherein the aiming system is vehicle based the frequencies $\omega_1$ and $\omega_2$ are near the rolling frequency of the vehicle when moving on the ground.

4. A device according to claim 1 wherein the aiming servo system consists of a land-based aiming system, and frequencies $\omega_1$ and $\omega_2$ are the expected movement frequency range of the target.

5. A device according to claim 1 wherein the gun servo system further comprises means for connecting the stabilizing and accuracy-increasing network only when the error signal of the gun servo system is below a certain value.

6. A device according to claim 1 wherein the gun servo system, in addition to the stabilizing and accuracy-increasing network comprises a load-compensating network of the same configuration as the integrating second-degree filters of the derivating type having breaking frequencies in the vincinity of the natural frequency of the system.

* * * * *